US008893699B2

(12) United States Patent
Bird et al.

(10) Patent No.: US 8,893,699 B2
(45) Date of Patent: Nov. 25, 2014

(54) PROJECTILE FIRING BUILDING ELEMENT

(71) Applicant: Hasbro, Inc., Pawtucket, RI (US)

(72) Inventors: David Maxwell Bird, Providence, RI (US); Robert C. Maschin, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 112 days.

(21) Appl. No.: 13/762,949

(22) Filed: Feb. 8, 2013

(65) Prior Publication Data

US 2014/0090630 A1 Apr. 3, 2014

Related U.S. Application Data

(60) Provisional application No. 61/707,432, filed on Sep. 28, 2012.

(51) Int. Cl.
*F41B 7/08* (2006.01)
*F41B 15/00* (2006.01)

(52) U.S. Cl.
CPC .. *F41B 15/00* (2013.01); *F41B 7/08* (2013.01)
USPC ..... 124/79; 124/31; 446/102; 446/473

(58) Field of Classification Search
USPC ..... 446/102, 473, 486, 63, 399, 401; 273/317, 405; 124/1, 31, 79; 473/578
See application file for complete search history.

(56) References Cited

U.S. PATENT DOCUMENTS

| | | | | |
|---|---|---|---|---|
| 379,913 | A * | 3/1888 | Stockton | 124/10 |
| 3,035,564 | A * | 5/1962 | Hellman | 124/26 |
| 3,788,643 | A * | 1/1974 | Morrison et al. | 273/379 |
| 5,213,089 | A * | 5/1993 | DeLuca | 124/29 |
| 5,334,079 | A * | 8/1994 | Gentile et al. | 446/486 |
| 5,645,463 | A | 7/1997 | Olsen | |
| 5,707,271 | A | 1/1998 | Kunz | |
| 6,086,446 | A | 7/2000 | Arriola | |
| 6,523,535 | B2 | 2/2003 | Rehkemper | |
| D608,400 | S | 1/2010 | Ryaa | |
| 7,708,615 | B2 | 5/2010 | Munch | |
| 2007/0119440 | A1 * | 5/2007 | Andersen | 124/79 |
| 2008/0313947 | A1 * | 12/2008 | Fachner | 43/1 |
| 2013/0167820 | A1 * | 7/2013 | Gilbertson | 124/62 |
| 2014/0141691 | A1 * | 5/2014 | Canobbio | 446/486 |

OTHER PUBLICATIONS

Photo of Zamor Launcher, available at: http://www.brickshelf.com/gallery/GnarlyMudkip/GizmosAndGadgets/zamormodtop.jpg, downloaded Jan. 14, 2013.
Zamor Launcher, available at: http:biosector01.com/wiki/index.php/Zamor_Launcher, 3 pages, downloaded Jan. 14, 2013.
Lego 92280 Plate, Modified 1x2 With Clip on Top—Rebrickable, available at: http://rebrickable.com/parts/92280, downloaded Aug. 22, 2012.
Shadow Blaster, available at: http://custombionicle.wikia.com/wiki/Shadow_Blaster, 1 page, downloaded Jan. 14, 2013.
Flick Fire Missiles, available at http://legostarwars.wikia.com/wiki/Flick_fire_missiles, downloaded Jan. 28, 2013.

* cited by examiner (Continued)

*Primary Examiner* — Gene Kim
*Assistant Examiner* — John E Simms, Jr.
(74) *Attorney, Agent, or Firm* — DiBerardino McGovern IP Group LLC

(57) ABSTRACT

A toy assembly includes a projectile that includes a linear portion and an engagement portion. The toy assembly also includes a base that includes a pivot point and defines an opening that receives the linear portion of the projectile, and the base retains the projectile in a frictional engagement. The assembly also includes an actuator that includes a trigger portion. The actuator is coupled to the base at the pivot point. Applying force to the trigger portion of the actuator in a first direction causes movement of the engagement portion of the projectile in a second direction, distinct from the first direction, and releases the projectile from the frictional engagement.

27 Claims, 11 Drawing Sheets

FIG. 6A
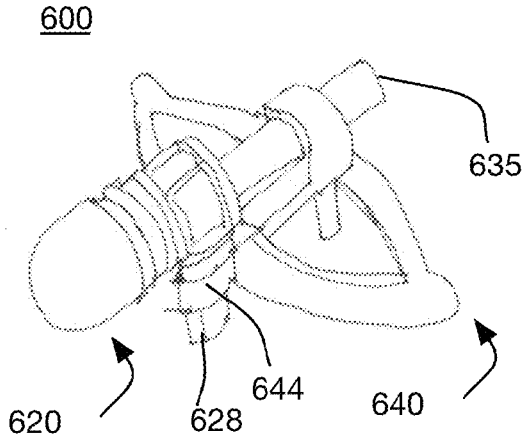
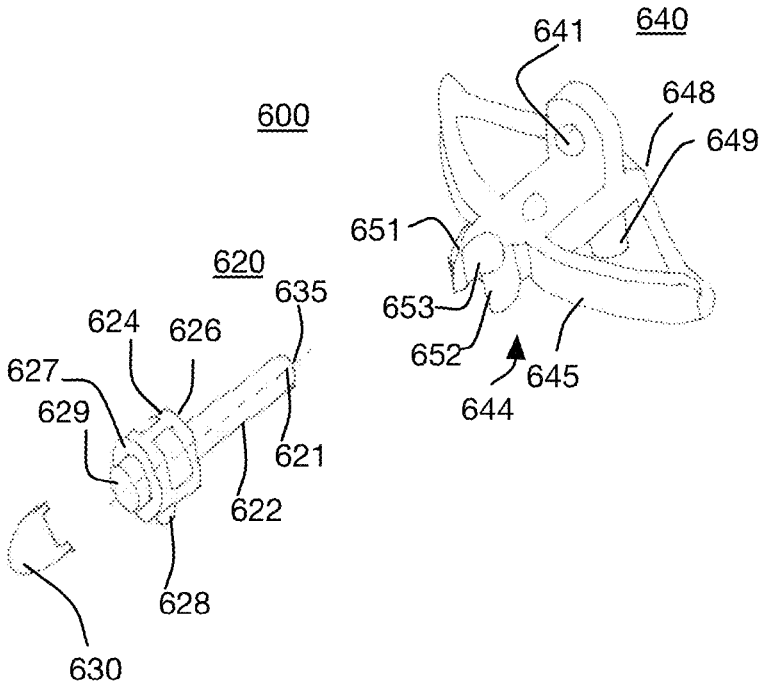
FIG. 6B

PROJECTILE FIRING BUILDING ELEMENT

CROSS-REFERENCE TO RELATED APPLICATION

This application claims priority to U.S. Provisional Application No. 61/707,432, filed on Sep. 28, 2012 and entitled PROJECTILE FIRING BUILDING ELEMENT, which is incorporated herein by reference in its entirety.

TECHNICAL FIELD

This disclosure relates to a projectile firing building element.

BACKGROUND

Children enjoy playing and interacting with toys that move. Typically, movement or animation in toys can be produced using a set of gears and springs mechanically coupled to the toy.

Toy construction sets are made up of a plurality of building elements, which include coupling mechanisms such as studs or recesses of specific heights and placement to enable interconnection with other building elements.

SUMMARY

In one general aspect, a toy assembly includes a projectile that includes a linear portion and an engagement portion. The toy assembly also includes a base that includes a pivot point and defines an opening that receives the linear portion of the projectile, and the base retains the projectile in a frictional engagement. The assembly also includes an actuator that includes a trigger portion. The actuator is coupled to the base at the pivot point. Applying force to the trigger portion of the actuator in a first direction causes movement of the engagement portion of the projectile in a second direction, distinct from the first direction, and releases the projectile from the frictional engagement.

Implementations may include one or more of the following features. The first direction can be toward a surface that holds the pivot point, and the second direction can be parallel to a longitudinal axis of the linear portion of the projectile.

The actuator can include a wall portion configured to contact the engagement portion of the projectile, and applying force to the trigger portion of the actuator can cause the wall portion to push the engagement portion of the projectile in the second direction. The engagement portion of the projectile can include a flat face extending radially from a longitudinal axis of the linear portion.

The base can include a clamp, and the frictional engagement can include placing part of the projectile in the clamp. One or more of the clamp or the pivot point can include a c-clip. When the clamp is a c-clip, the projectile can further include a post that extends radially from the projectile, and the post is the part of the projectile that is placed in the c-clip.

The base can further include a coupling stud and a coupling recess for connecting the base to a separate building element. The base can include a first building element that is releasably coupled to a second building element and a third building element, where the second building element includes the clamp and the third building element includes the pivot point. The clamp can be at a first side of the base and the pivot point can be at a second side of the base, where the first side has a normal perpendicular to a normal of the second side. The clamp can protrude from the first side of the base, and the pivot point can protrude from the second side of the base.

The base can define a second opening through which an end of the linear portion of the projectile is accessible. The trigger portion of the actuator can include a coupling stud. The actuator can include a recess that accepts the protruding pivot point to couple the actuator to the base. The wall portion of the actuator can define a notch configured for placement around the linear portion of the projectile. The linear portion of the projectile can have a circular cross-section.

In another general aspect, a toy construction system includes a projectile including a linear portion having a first end and a second end, and an engagement portion at the first end. The system also includes a base including a clamp and a pivot point, the base defining a first opening that receives the second end of the linear portion of the projectile and a second opening that provides access to the second end of the linear portion, and the clamp retaining a portion of the projectile. The system also includes a first actuator removably coupled to the pivot point, the first actuator configured to cause release of the projectile from the clamp in a direction parallel to a longitudinal axis of the linear portion when force is applied to the first actuator in a direction that is different from the direction parallel to the longitudinal axis of the linear portion, and a second actuator configured to cause release of the projectile from the clamp when force is applied to the second end of the linear portion of the projectile.

Implementations can include one or more of the following features. The second actuator can include a building element that pushes the second end of the linear portion. The second end of the linear portion can pass through the second opening to an exterior of the base. The first actuator can include a wall portion and a trigger portion. The wall portion can be configured to contact the engagement portion of the projectile, and applying force to the first actuator can include applying force to the trigger portion in a direction that is towards a surface that holds the pivot point to cause the wall portion to move the engagement portion of the projectile in the direction parallel to the longitudinal axis of the linear portion of the projectile. The base can include a coupling stud and a coupling recess.

In another general aspect, a device includes a projectile including a linear portion that extends along a longitudinal axis, and a flat face and a post that extend radially from the longitudinal axis. The device also includes a base with a coupling stud, a coupling recess, a pivot point, and a clamp, where the base defines an opening in one side that receives the linear portion of the projectile, and the clamp retains the linear portion of the projectile in the base. The device also includes an actuator coupled to the base at the pivot point, the actuator includes a wall portion and a trigger portion, the wall portion being disposed between the flat face of the projectile and the side of the base that defines the opening.

In another general aspect, a toy construction system includes a plurality of interconnectible building elements, and a toy assembly configured to connect to at least one of the interconnectible building elements. The toy assembly includes a projectile that includes a linear portion and an engagement portion, and a base that includes a pivot point and defines an opening that receives the linear portion of the projectile, the base retaining the projectile in a frictional engagement. The toy assembly also includes an actuator including a trigger portion, the actuator coupled to the base at the pivot point. Applying force to the trigger portion of the actuator in a first direction causes movement of the engagement portion of the projectile in a second direction, distinct from the first direction, and releases the projectile from the frictional engagement.

In another general aspect, a toy assembly includes a projectile including a linear portion that extends along a longitudinal axis, the linear portion including a first end and a second end, and a post that extends radially outward from the longitudinal axis at the first end; and a base defining an opening that receives the linear portion, and the base including a clamp extending outward from a surface of the base, the clamp receiving the post that extends radially outward from the longitudinal axis, where the projectile is released from the base in response to a force applied directly to the second end of the linear portion.

Implementations can include one or more of the following features. The clamp can include a c-clip. The base further can include a post sized to fit into a c-clip of a building element that is separate and distinct from the projectile and the base. When the projectile is released from the base, the post can be released from the clamp.

The subject matter discussed above can be implemented as a toy assembly, a kit for a toy assembly, a toy construction system, a system that includes a toy assembly, a device, and/or a method or process for using a toy assembly. Further features and advantages will become more readily apparent from the following detailed description when taken in conjunction with the accompanying drawings.

DRAWING DESCRIPTION

The present disclosure is further described in the detailed description that follows, in reference to the noted drawings by way of non-limiting examples of exemplary implementations, in which like reference numerals represent similar parts throughout the several views of the drawings, and wherein:

FIG. 6A is a perspective view of another exemplary toy assembly.

FIG. 6B is an exploded perspective view of the toy assembly of FIG. 6A.

DESCRIPTION

A toy assembly having a projectile, a base, and an actuator (or hinge) is disclosed. The base of the toy assembly holds the projectile. Applying force to the actuator causes the release (or firing) of the projectile, and the released projectile moves away from the base in a direction that is different from the direction of the applied force. In some implementations, the projectile can be released in multiple ways. In some implementations, the projectile can be released by applying force directly to one end of the projectile. The toy assembly can be used on its own or as part of a larger toy system that is assembled by connecting the toy assembly to one or more other components, such as interconnecting building elements.

Figure 1A:
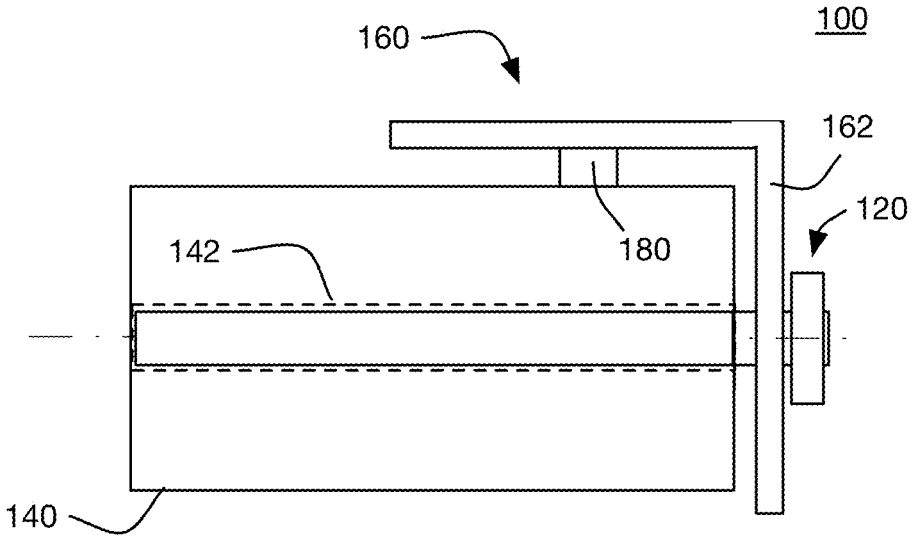
FIG. 1A is a side view of an exemplary toy assembly that includes a projectile held in a base.
Figure 1B:
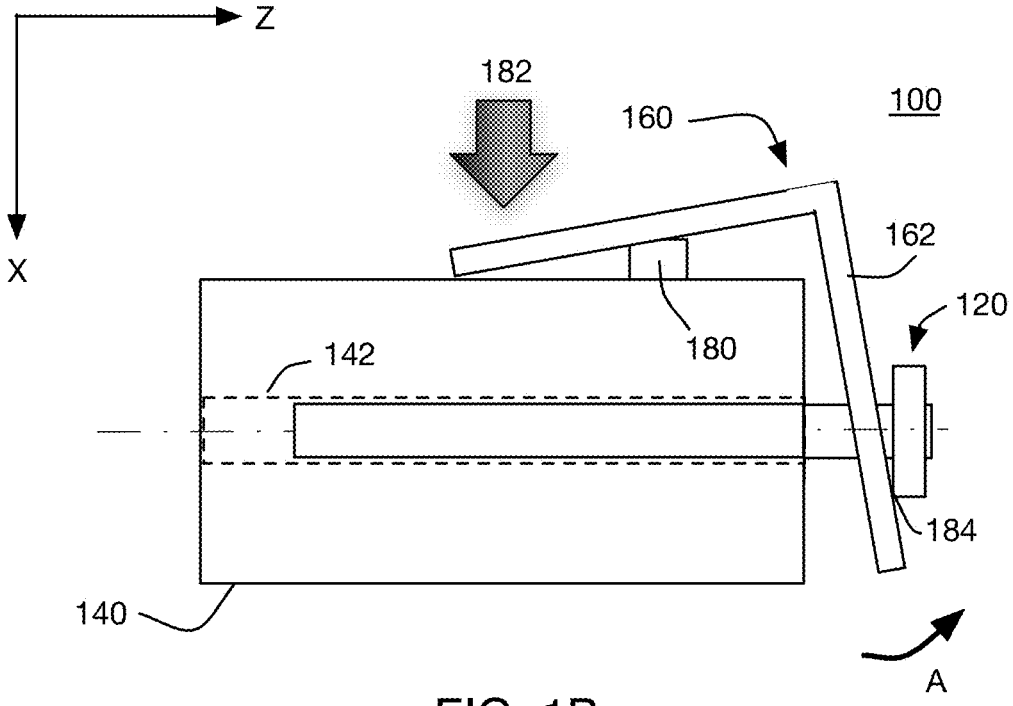
FIG. 1B is a side view of the exemplary toy assembly of FIG. 1A with the projectile released.

Referring to FIG. 1A, an exemplary toy assembly 100 includes a projectile 120, a base 140 that receives the projectile 120 in an opening 142, and an actuator 160. The actuator 160 is coupled to the base 140 at a pivot point 180. Referring also to FIG. 1B, the toy assembly 100 fires the projectile 120 in response to a force 182 that is applied to the actuator 160 in a direction "X". Application of the force 182 to the actuator 160 causes the actuator 160 to rotate about the pivot point 180 such that a wall portion 162 of the actuator 160 tilts away from the base 140 along an arc "A." The tilting wall portion 162 contacts the projectile 120 at an interface 184, thus pushing the projectile 120 in a direction "Z." Consequently, the projectile 120 is released from the base 140 and moves along the direction "Z."

Figure 2A:
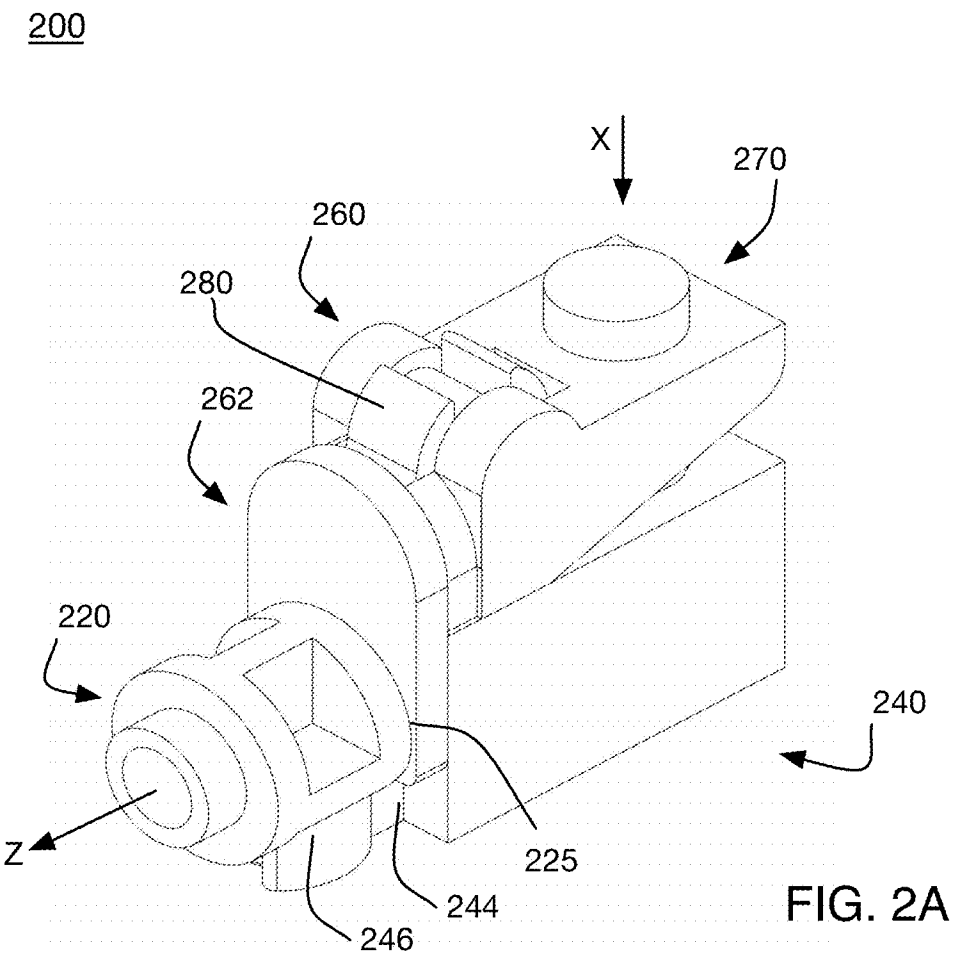
FIG. 2A is a perspective view of another exemplary toy assembly.

Referring to FIG. 2A, a perspective view of another exemplary toy assembly 200 is shown. The toy assembly 200 includes a projectile 220 that is received and held in a base 240. The projectile 220 is released from the base 240 in response to application of a force on an actuator 260 that is coupled to the base 240 at a pivot point 280. In greater detail, when force is applied to a trigger portion 270 of the actuator 260 in a direction "X," the actuator 260 rotates about the pivot point 280, causing a wall portion 262 of the actuator 260 to tilt away from a surface 244 of the base 240. The tilting wall portion 262 pushes on the projectile 220 to release the projectile 220 from the base 240. Once released, the projectile 220 moves away from the base 240 along a direction "Z." As such, application of force to the toy assembly 200 in one direction causes the projectile 220 to be released from the base 240 and travel in a direction ("Z") that is different than the direction of the applied force ("X").

Figure 2B:
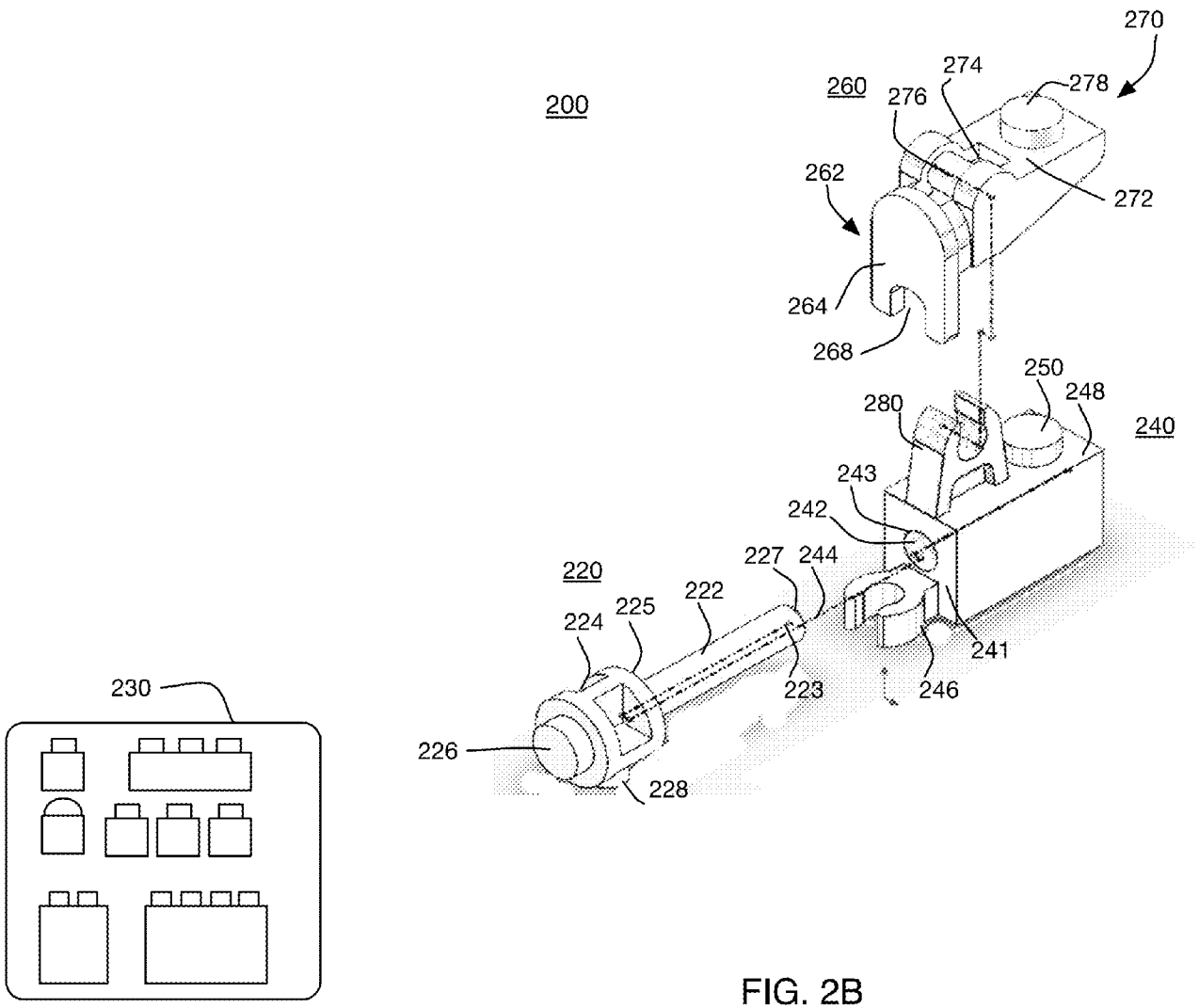
FIG. 2B is an exploded perspective view of the toy assembly of FIG. 2A.

Referring also to FIG. 2B, the projectile 220 includes a linear portion 222, an engagement portion 224, a coupling stud 226, and a post 228. The linear portion 222 extends along a longitudinal axis 223, and the engagement portion 224 and the post 228 extend radially from the longitudinal axis 223. The engagement portion 224 has a flat face 225 configured for contact with the actuator 260. The coupling stud 226 allows the projectile to be connected to one or more building elements in a construction set 230.

The base 240 includes a side 241 that defines a first end 243 of an opening 242 that receives the projectile 220. The opening 242 extends into the base 240 and defines an axis 244. The side 241 also includes a clamp 246. The clamp 246 holds the post 228 of the projectile 220 to retain the projectile 220 in the base 240. The clamp 246 includes a c-clip that extends outward from the base 240 in a direction that is normal to the surface of the side 241. The base 240 also includes the pivot point 280. The pivot point 280 includes a c-clip that extends outward from the base 240 along a direction that is normal to a surface 248. In the toy assembly 200, the clamp 246, and the pivot point 280 are integral with the base 240 such that the base 240 is a single piece.

The base 240 can include one or more coupling mechanisms that allow interconnection with other building elements. For example, the base 240 includes a stud 250, and the bottom of the base 240 can include one or more recesses (not shown) sized and arranged to accept and hold one or more studs of other building elements of the construction set 230.

The actuator 260 includes a wall portion 262 and a trigger portion 270. The wall portion 262 defines a notch 268. When the actuator 260 is coupled to the base 240 at the pivot point 280, the notch 268 fits over and partially surrounds the linear portion 222 of the projectile 220. The wall portion 262 also includes a flat surface 264 that engages with at least part of the face 225 of the projectile 220.

The trigger portion 270 of the actuator 260 includes a surface 272 having a recess 274 and a bar 276. The recess 274 and the bar 276 receive the pivot point 280 to couple the actuator 260 to the base 240. The trigger portion 270 also includes a stud 278. The stud 278 allows interconnection of the trigger portion 270 with other building elements of the construction set 230. The stud 278 also can be the portion of the actuator 260 that receives the force for releasing the projectile 220.

Figure 2C:
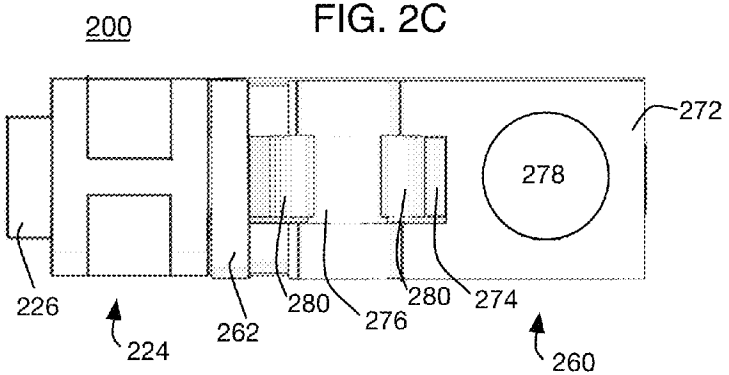
FIG. 2C is a top view of the toy assembly of FIG. 2A.
Figure 2E:
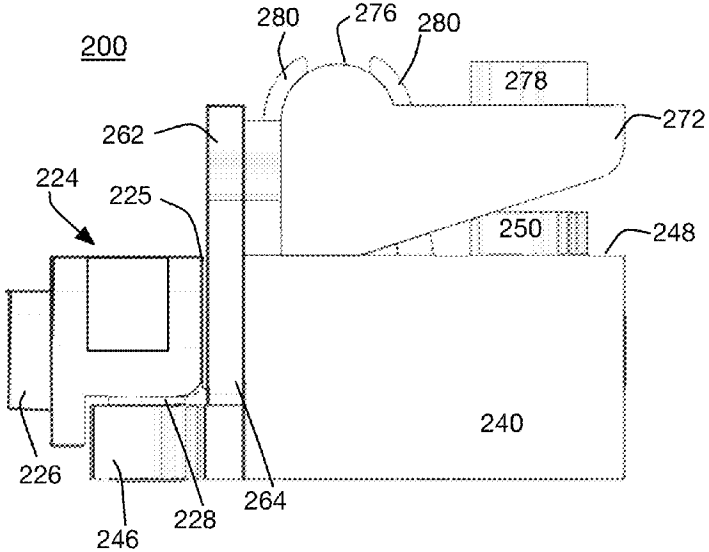
FIG. 2E is a side view of the toy assembly of FIG. 2A.
Figure 2D:
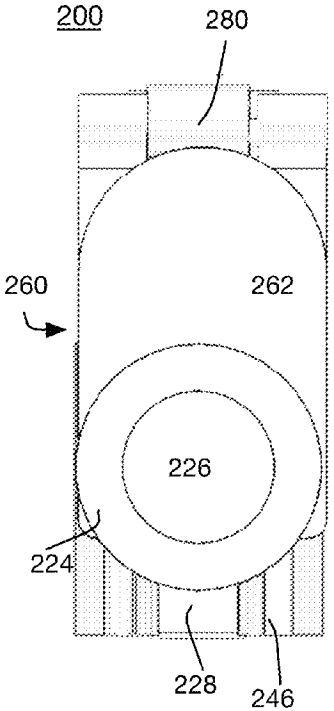
FIG. 2D is a front view of the toy assembly of FIG. 2A.
Figure 2F:
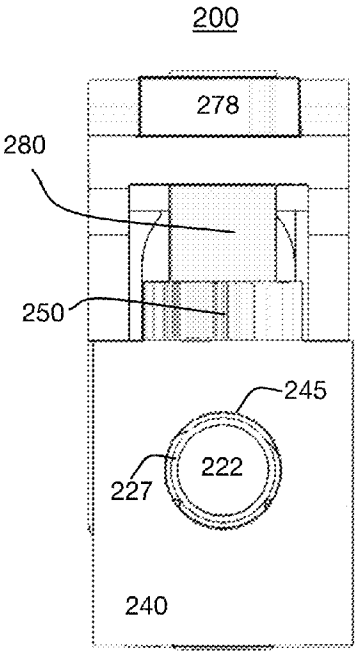
FIG. 2F is a rear view of the toy assembly of FIG. 2A.

FIGS. 2C-2F are, respectively, top, front, side, and rear views of the exemplary toy assembly 200. Referring to FIG. 2C, the bar 276 of the actuator 260 snaps into the c-clip of the pivot point 280 to couple the actuator 260 to the base 240. Referring to FIG. 2D, the c-clip of the clamp 246 holds the post 228 of the projectile 220. As shown in FIG. 2E, when the actuator 260 is coupled into the pivot point 280 and the projectile 220 is inserted in the base 240, the wall portion 262 of the actuator 260 is disposed between the engagement portion 224 of the projectile 220 and the base 240. Referring to FIG. 2F, the linear portion 222 of the projectile 220 has a circular cross-section. The end 227 of the projectile 220 is accessible from an exterior of the base 240 through an opening 245 defined in a rear side of the base 240.

Figure 3A:
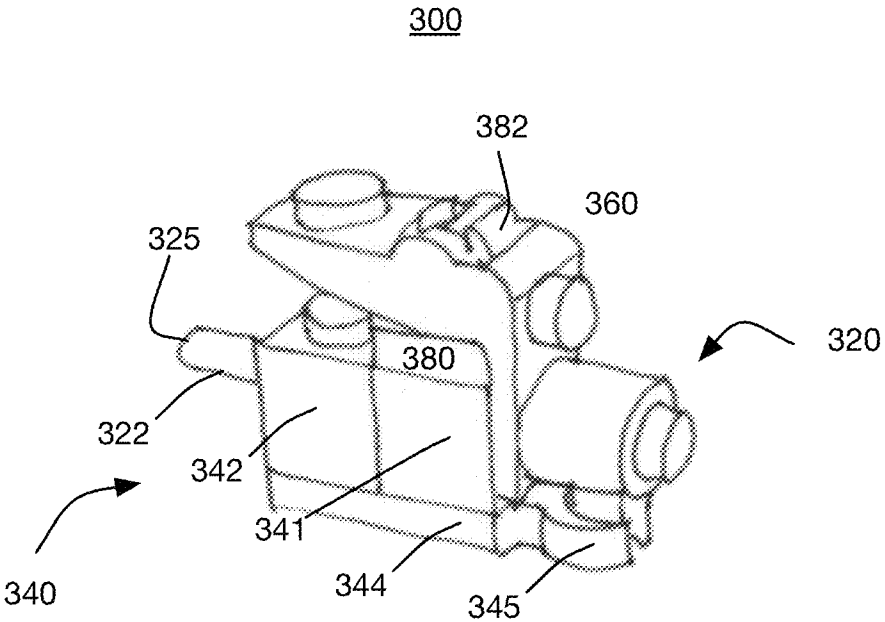
FIG. 3A is a perspective view of another exemplary toy assembly.

Referring to FIG. 3A, a perspective view of another exemplary toy assembly 300 is shown. The toy assembly 300 includes a projectile 320, a base assembly 340, and an actuator 360. In the toy assembly 300, instead of being a single piece, the base assembly 340 is formed from multiple interconnecting building elements.

Figure 3B:
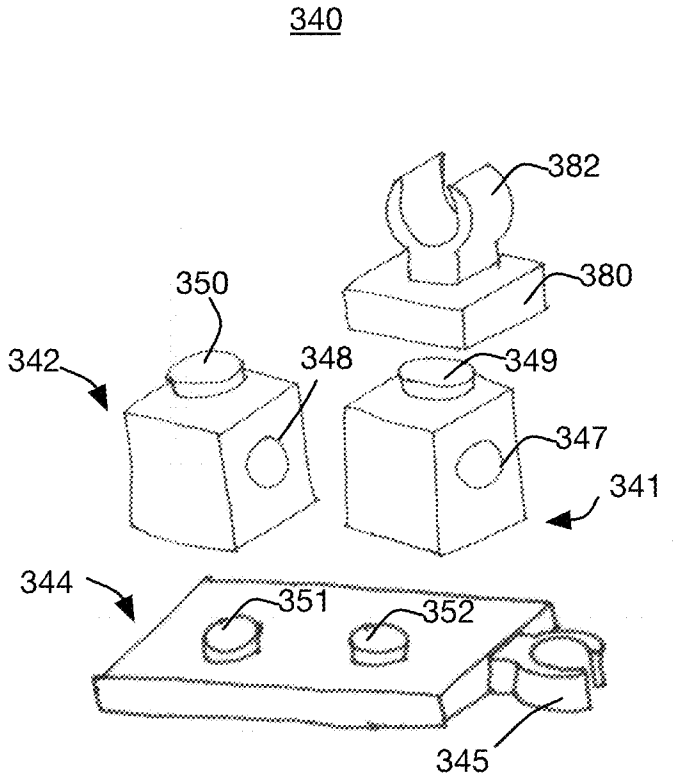
FIG. 3B is an exploded perspective view of a base assembly of the toy assembly shown in FIG. 3A.

FIG. 3B is an exploded perspective view of the building elements of the base assembly 340. The building elements for the base assembly 340 include two base blocks 341 and 342, a clamp block 344, and a pivot point 380. The base blocks 341 and 342 define respective openings 347 and 348. The clamp block 344 includes a c-clip 345. The base blocks 341 and 342 also include respective studs 349 and 350, and each of the base blocks 341 and 342 include recesses in a bottom side (not shown) that allow the base blocks 341 and 342 to interconnect with studs 351 and 352 of the clamp block 344.

Figure 3C:
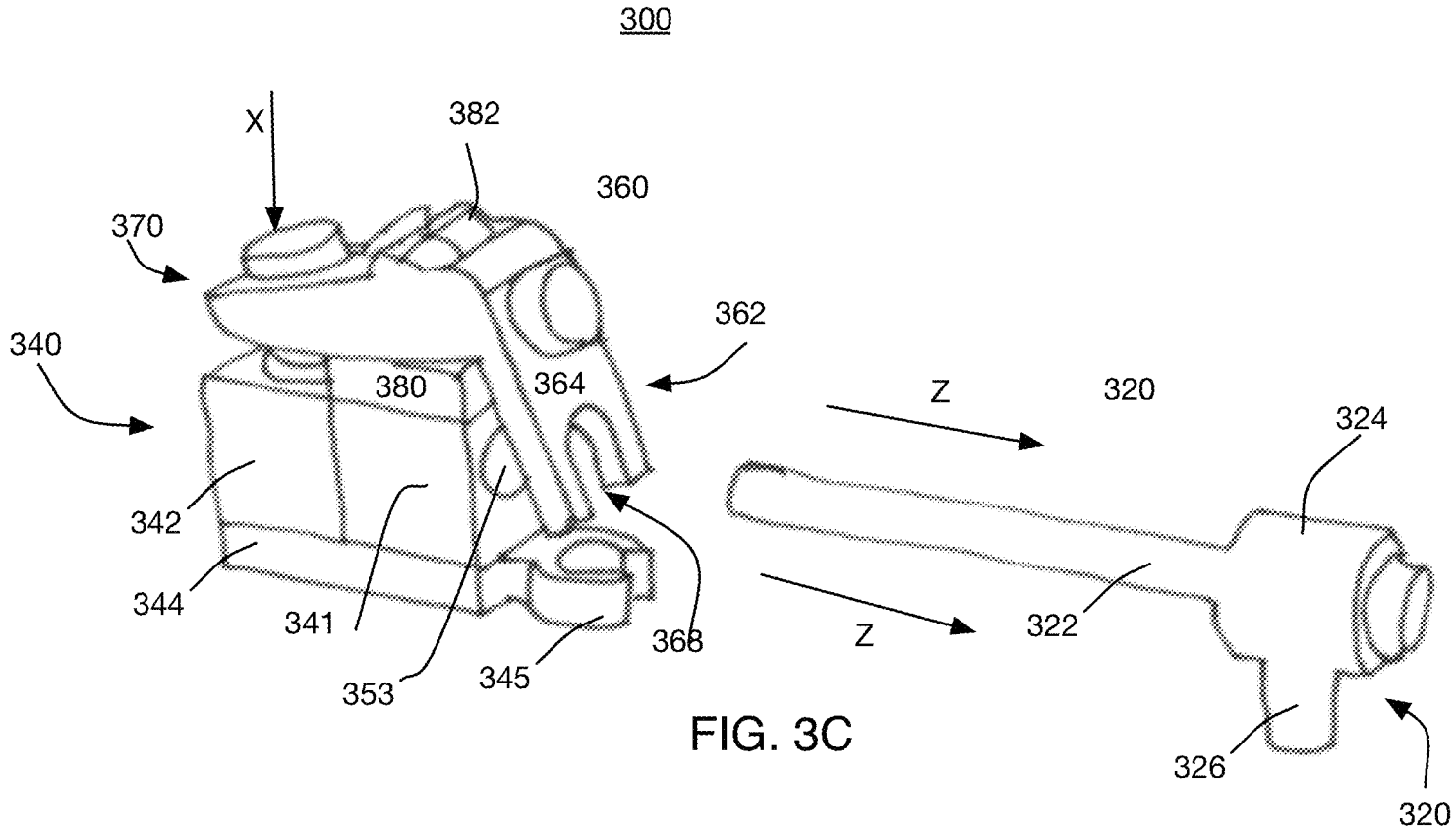
FIG. 3C is a perspective view of the exemplary toy assembly shown in FIG. 3A with the projectile released.

FIGS. 3A and 3C show the toy assembly 300 with the base assembly 340 in an assembled state. Referring again to FIG. 3B, to assemble the base assembly 340, studs 351 and 352 on the clamp block 344 are connected the bottom sides of the base blocks 341 and 342. Connecting the base blocks 341 and 342 to the clamp block 344 results in the base blocks 341 and 342 being laterally displaced along the clamp block 344 with the centers of the openings 347 and 348 aligned. The aligned openings 347 and 348 define a passage 353 (FIG. 3C) through the base assembly 340.

As shown in FIGS. 3A and 3C, the pivot point 380 and the actuator 360 are connected to the base assembly 340. To connect the pivot point 380 to the base assembly 340, recesses (not shown) in the bottom of the pivot point 380 are connected to the stud 349 of the base block 341 such that a c-clip 382 of the pivot point 380 extends outward from the base block 341. The actuator 360 is coupled to the c-clip 382 to connect the actuator 360 to the base assembly 340.

The projectile 320 includes a linear portion 322, an engagement portion 324, and a post 328. The actuator 360 includes a wall portion 362 and a trigger portion 370. The wall portion 362 includes a surface 364 that contacts the engagement portion 324 of the projectile 320 when force is applied to the trigger portion 370. The wall portion 362 also defines a notch 368.

The projectile 320 is received in the base assembly 340 by inserting the linear portion 322 of the projectile 320 into the passage 353 until the post 328 snaps into the c-clip 345. Once the post 328 snaps into the c-clip 345, the wall portion 362 is disposed between the engagement portion 324 of the projectile 320 and the base block 341. Additionally, the linear portion 322 extends through the passage 353 such that an end 325 of the projectile 320 accessible from an exterior of the base assembly 340.

As shown in FIG. 3C, when force is applied to the actuator 360, the wall portion 362 tilts upward and away from the base block 341. The tilting wall portion 362 pushes against the engagement portion 324 to release the post 328 from the c-clip 345.

Figure 4B:
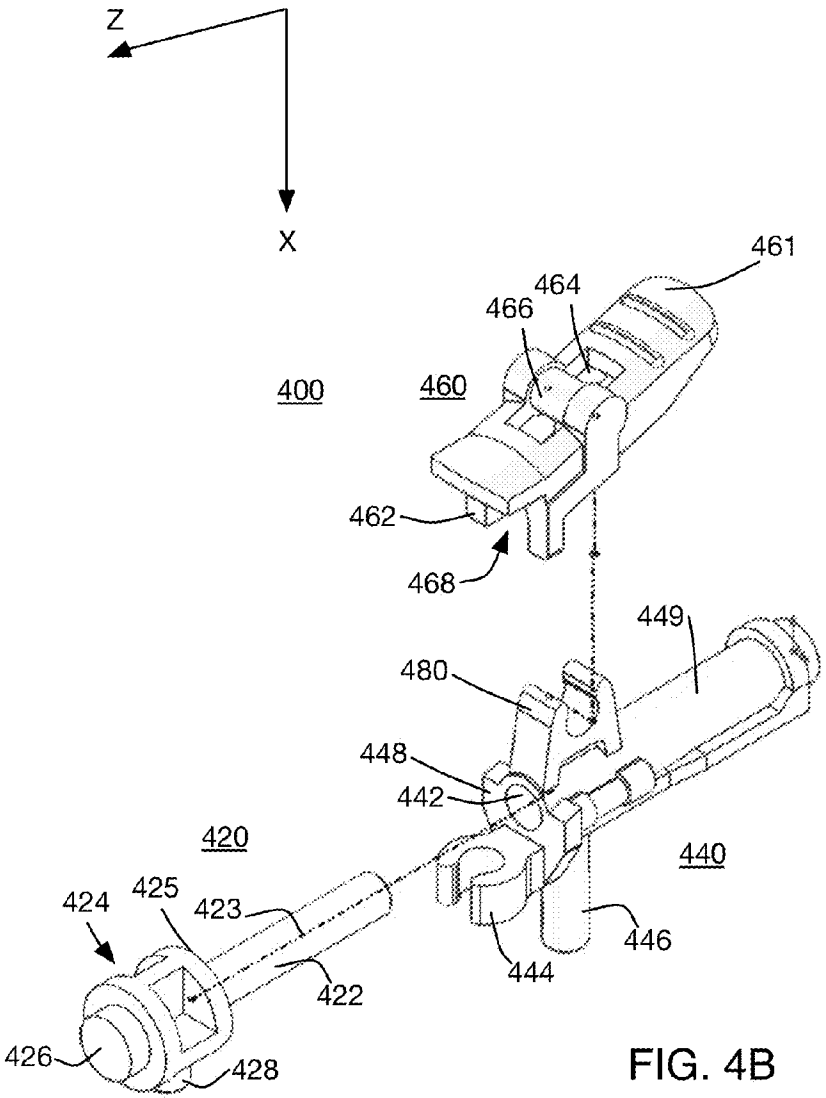
FIG. 4B is an exploded perspective view of the exemplary toy assembly of FIG. 4A.
Figure 4A:
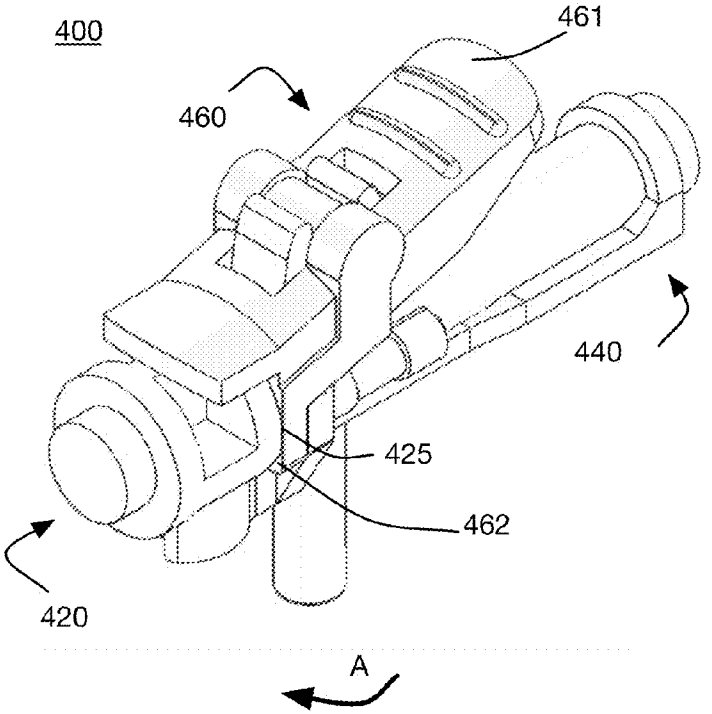
FIG. 4A is a perspective view of another exemplary toy assembly.

Referring to FIG. 4A, another example of a toy assembly 400 is shown. The toy assembly 400 includes a projectile 420, a base 440, and an actuator 460. The projectile 420 is held in the base 440. Applying pressure to an end 461 of the actuator 460 in a direction "X" causes a wall portion 462 of the actuator 460 to tilt away from the base 440 along an arc "A". The tilting wall portion 462 presses against the projectile 420 and overcomes a frictional engagement that holds the projectile 420 in the base 440. As a result, the projectile 420 is released from the base 440 along a direction "Z." Thus, the toy assembly 400 allows the projectile 420 to be fired in a direction different from the direction of the applied force.

Referring also to FIG. 4B, the base 440 includes a body 449, a clamp 444, a base post 446, a wall 448 that defines an opening 442, and a pivot point 480. The clamp 444 includes a c-clip that extends along a direction normal to a surface of the wall 448, and the pivot point 480 includes a c-clip that extends outward from a surface of the body 449. The size of the opening of the c-clip can be varied to control how far the projectile 420 is shot. The base 440 also includes the base post 446, which can be used to couple the base 440 to, for example, another building element or a mount. For instance, the post 446 can be received in a c-clip that forms a hand of a toy action figure (not shown). The base post 446 can also be used as a grip for an operator who uses the toy assembly 400, for example, when the toy assembly 400 is not connected to another building element.

The actuator 460 is connected to the base 440 by coupling a recess 464 and bar 466 of the actuator 460 to the pivot point 480. When the actuator 460 is connected to the base, the wall portion 462 extends along the wall 448 such that a notch 468, defined by the wall portion 462, is placed over the opening 442. Consequently, connection of the actuator 460 to the base 440 does not obstruct the opening 442.

The projectile 420 is received in the base 440 through the opening 442. The projectile 420 includes a linear portion 422, an engagement portion 424, a stud 426, and a post 428. The linear portion 422 extends along a longitudinal axis 423 and has a circular cross-section. When the linear portion 422 is received in the opening 442, the post 428 of the projectile 420 snaps into the clamp 444 and holds the post 428 in frictional engagement. Additionally, when the projectile 420 is inserted into the opening 442, the wall portion 462 is captured between the engagement portion 424 of the projectile 420 and the wall 448 of the base 440. The positioning of the wall portion 462 relative to the engagement portion 424 allows the actuator 460 to act as the firing mechanism for the projectile 420. In the example shown, a force applied to the end 461 of the actuator 460 causes the wall portion 462 to tilt upward, away from the wall 443, thus pushing the post 428 out of the clamp 444.

Figure 5A:
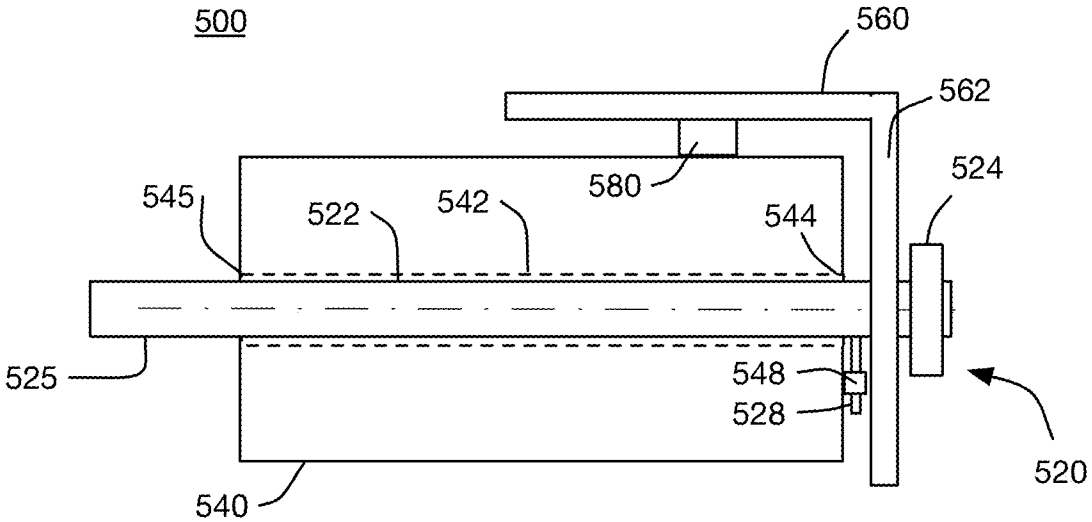
FIG. 5A is a side view of another exemplary toy assembly.
Figure 5B:
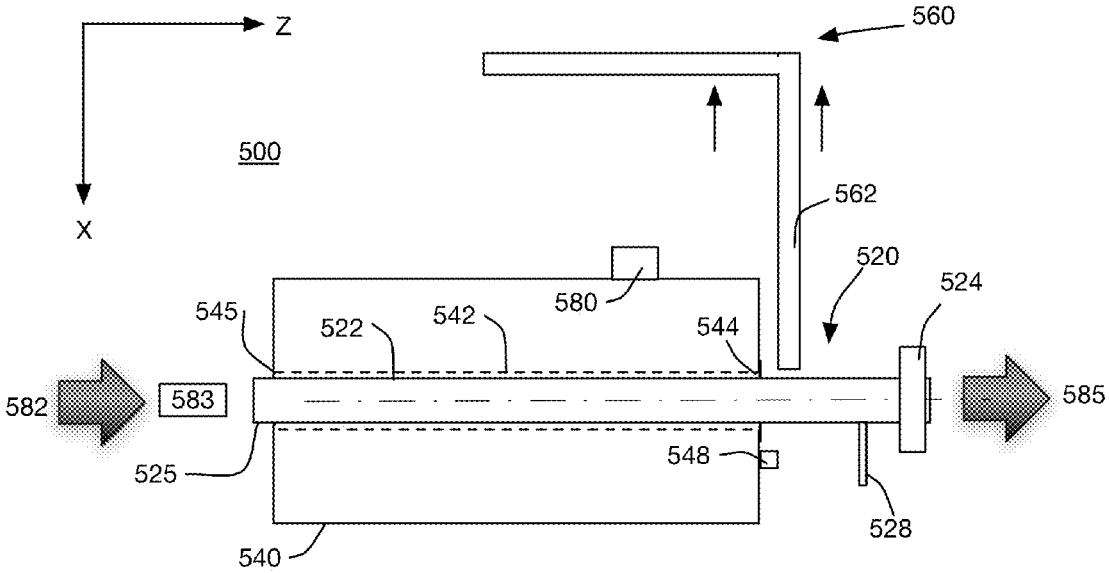
FIG. 5B is a side view of the toy assembly of FIG. 5A releasing a projectile in a first manner.
Figure 5C:
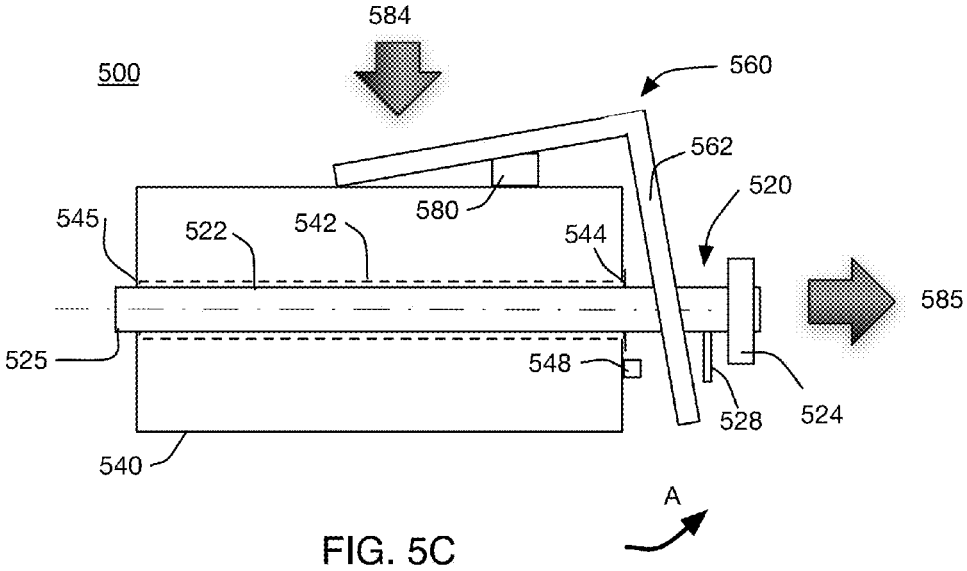
FIG. 5C is a side view of the toy assembly of FIG. 5A releasing a projectile in a second manner.

Referring to FIGS. 5A-5C, side views of an example of a toy construction system 500 are shown. The system 500 can fire a projectile 520 in two different ways. FIG. 5A is a side view of the system 500 before the projectile 520 is fired. FIG. 5B is a side view of the system 500 being fired in a first way, and FIG. 5C is a side view of the toy system being fired in a second way. As shown in FIG. 5B, applying a force 582 to an end 525 of the projectile 520 fires the projectile 520 in a direction 585. As shown in FIG. 5C, applying a force 584 to a first actuator 560 causes a wall portion 562 of the first actuator 560 to tilt and push the projectile 520 out of the system 500 in the direction 585.

The system 500 includes a projectile 520, a base 540, and a first actuator 560. The projectile 520 is received in a passage 542 that extends through the base 540 from a first opening 544 to a second opening 545. The projectile 520 includes a linear portion 522, an engagement portion 524, an end 525, and a post 528. The projectile 520 is held in the base 540 through a frictional engagement between the post 528 and a clamp 548, and the end 525 is accessible from an exterior of the base 540.

Referring to FIG. 5B, the projectile 520 is released from the base 540 when a force 582 sufficient to overcome the frictional engagement between the post 528 and the clamp 548 is applied to the end 525 in a direction "Z." To release the projectile 520, an operator of the system 500 applies the force 582 to the end 525 through an element 583. The element 583 can be referred to as a second actuator. The element 583 can be, for example, a tool that makes direct contact with the end 525, another building element that is indirectly connected to the end 525, or a portion of the operator, such as a part of the operator's hand, that makes direct physical contact with the end 525.

In the example of FIG. 5B, the first actuator 560 is removed from the base 540 before the force 582 is applied. The pivot point 580 can be a c-clip that receives and holds a portion of the first actuator 560, but also allows the first actuator 560 to be removed from the base 540. For example, the first actuator 560 can be removed from the pivot point 580 by pulling the first actuator 560 away from the pivot point 580 to release the first actuator 560 from the frictional engagement provided by the c-clip.

Although FIG. 5B shows the projectile 520 being released with the first actuator 560 removed, the projectile 520 can be fired from the system 500 without removing the first actuator 560. The first actuator 560 includes a wall portion 562 that defines a notch (not shown) that partially surrounds the linear portion 522 of the projectile 520 without obscuring the first opening 544. Thus, the projectile 520 can be ejected from the base 540 without removing or moving the first actuator 560.

Referring to FIG. 5C, the projectile 520 is released from the base 540 in response to the application of the force 584 to the first actuator 560. The force 584 is applied in a direction "X", causing the wall portion 562 to tilt away from a side 546 along an arc "A." The tiling wall portion 562 presses against the engagement portion 524 to overcome the frictional engagement between the post 528 and the clamp 548 and release the projectile 520 from the base 540. Once released, the projectile 520 exits the base 540 in the direction "Z."

Referring to FIG. 6A, a perspective view of another toy assembly 600 is shown. The toy assembly 600 includes a projectile 620 that is received in a base 640. The projectile 620 is held in the base 640 by a clamp 644. The projectile 620 is released from the base 640 in response to a force being directly applied to a second end 635 of the projectile 620. Application of force to the second end 635 causes the projectile 620 to be entirely released from the base 640. In other words, the projectile 620 and the second end 635, which is the portion of the toy assembly 600 that is used to eject the projectile 620 from the base 640, are a single element and both are disconnected from the base 640 in response to the application of force.

Referring also to FIG. 6B, an exploded perspective view of the toy assembly 600 is shown. The projectile 620 defines a longitudinal axis 621, and includes a linear portion 622 and a post 628. The linear portion 622 extends along the longitudinal axis 621, and the post 628 extends radially outward along a direction that is normal to the longitudinal axis 621.

The projectile 620 also includes a collar 624 that defines flat faces 626 and 627. The flat face 627 includes a stud 629 that connects to a cavity on a separate building element, a protective piece, or a decorative element. In the example of FIG. 6B, the stud 629 connects to an end cap 630.

The base 640 includes the clamp 644 that protrudes from a side 645 of the base 640. The clamp 644 is a single-piece element that has a shape that changes only enough to open sufficiently to hold the post 628 in frictional engagement between prongs 651 and 652 that define an opening 653. In particular, to insert the post 628 into the clamp 644, the post 628 is pressed against the prongs 651 and 652 until the post 644 is received in the opening 653. When the force is applied to the second end 635, the prongs 651 and 652 are forced open as the post 628 moves outward from the base 640. As the post 628 moves forward, the clamps 651 and 652 squeeze the post 628 as the clamps 651 and 652 return to their original shape. The squeezing pushes the post 628, forcing the projectile 620 forward so that the projectile launches from the base 640. In other words, the clamp 644 holds the projectile 620 in the base with the prongs 651 and 652, and the prongs 651 and 652 also provides at least part of the mechanism and/or force that propels the projectile 620 away from the base.

The clamp 644 can be a c-clip, as shown in the example of FIG. 6B. As compared to other connection mechanisms, the c-clip offers a compact design that can be sized to be the scale of the base 640 and makes a minimal visual and structural impact on the base 640.

The clamp 644 receives the post 628 of the projectile, and frictional engagement between the post 628 and the clamp 644 holds the projectile 620 to the base. The base 640 also defines an opening 641 that receives the linear portion 622 of the projectile 620. The second end 635 extends outwardly from a side 648 of the base 640 and is accessible from an exterior of the base 640. The projectile 620 is released from the base 640 when the force applied to the second end 635 is sufficient to overcome the frictional engagement between the post 628 and the clamp 644.

The base 640 also includes a post 649 that connects to a cavity or clip (such as a c-clip) on a separate element. For example, the post 649 can be received in a c-clip that forms a hand of an action figure toy (not shown).

Other implementations are within the scope of the following claims. For example, the projectiles 120, 220, 320, 420, and 520 can be held in their respective bases 140, 240, 240, 440, and 540 by a frictional engagement other than a c-clip that holds a portion of the projectile. For example, the projectiles 120, 220, 320, 420, and 520 can be held by an interference fit between the linear portion of the projectile and the opening defined by the base. In these implementations, the projectile can be held in the base without a post and a c-clip.

Any of the projectiles 120, 220, 320, 420, 520, and 620 can be used with any of the bases 140, 240, 340, 440, 540, or 640.

Any of the bases 140, 240, 240, 440, 540 and 640 of the respective toy assemblies 100, 200, 300, 400, 600, and the system 500 can be a molded, single-piece element or an assembly made from multiple interconnected components. The projectiles, bases, and/or actuators discussed above can be made of plastic.

The linear portions 122, 222, 322, 422, 522, and 622 can have a cross-section of any shape. For example, the linear portions 122, 222, 322, 422, 522, and 622 can have a cross-section in the shape of a circle, a square, a rectangle, a star, a hexagon, or an ellipse.

In implementations in which the clamp 246, 345, 444, 548, and/or 644 includes or is a c-clip, the size of the opening of the c-clip and/or the positioning of the prongs can be adjusted to control how far a projectile released from the c-clip travels.

While many alterations and modifications of the present disclosure will become apparent to a person of ordinary skill in the art after having read the foregoing description, it is to be understood that the particular embodiments shown and described by way of illustration are in no way intended to be considered limiting. Further, the disclosure has been described with reference to particular preferred embodiments, but variations within the spirit and scope of the disclosure will occur to those skilled in the art. The foregoing examples have been provided merely for the purpose of explanation and are in no way to be construed as limiting of the present disclosure. Although the present disclosure has been described with reference to exemplary implementations, the words, which have been used herein, are words of description and illustration, rather than words of limitation. Changes can be made, within the purview of the appended claims, as presently stated and as amended, without departing from the scope and spirit of the present disclosure in its aspects. Although the present disclosure has been described herein with reference to particular means, materials, and implementations, the present disclosure is not intended to be limited to the particulars disclosed herein; rather, the present disclosure extends to all functionally equivalent structures, methods and uses, such as are within the scope of the appended claims.

What is claimed is:

1. A toy assembly comprising:

a projectile comprising a linear portion and an engagement portion;

a base comprising a pivot point and defining an opening that receives the linear portion of the projectile, the base retaining the projectile in a frictional engagement; and an actuator comprising a trigger portion, the actuator coupled to the base at the pivot point, wherein applying force to the trigger portion of the actuator in a first direction causes movement of the engagement portion of the projectile in a second direction, distinct from the first direction, and releases the projectile from the frictional engagement.

2. The toy assembly of claim 1, wherein the actuator comprises a wall portion configured to contact the engagement portion of the projectile, and applying force to the trigger portion of the actuator causes the wall portion to push the engagement portion of the projectile in the second direction.

3. The toy assembly of claim 2, wherein the engagement portion of the projectile comprises a flat face extending radially from a longitudinal axis of the linear portion.

4. The toy assembly of claim 1, wherein the base further comprises a clamp, and the frictional engagement comprises placing part of the projectile in the clamp.

5. The toy assembly of claim 4, wherein one or more of the clamp or the pivot point comprises a c-clip.

6. The toy assembly of claim 5, wherein the clamp comprises a c-clip, the projectile further comprises a post that extends radially from the projectile, and the post is the part of the projectile that is placed in the c-clip.

7. The toy assembly of claim 1, wherein the base further comprises a coupling stud and a coupling recess for connecting the base to a separate building element.

8. The toy assembly of claim 4, wherein the base comprises a first building element that is releasably coupled to a second building element and a third building element, the second building element comprising the clamp and the third building element comprising the pivot point.

9. The toy assembly of claim 4, wherein the clamp is at a first side of the base and the pivot point is at a second side of the base, the first side having a normal perpendicular to a normal of the second side.

10. The toy assembly of claim 9, wherein the clamp protrudes from the first side of the base, and the pivot point protrudes from the second side of the base.

11. The toy assembly of claim 1, wherein the first direction is toward a surface that holds the pivot point, and the second direction is parallel to a longitudinal axis of the linear portion of the projectile.

12. The toy assembly of claim 1, wherein the base defines a second opening through which an end of the linear portion of the projectile is accessible.

13. The toy assembly of claim 1, wherein the trigger portion of the actuator comprises a coupling stud.

14. The toy assembly of claim 10, wherein the actuator comprises a recess that accepts the protruding pivot point to couple the actuator to the base.

15. The toy assembly of claim 2, wherein the wall portion of the actuator defines a notch configured for placement around the linear portion of the projectile.

16. The toy assembly of claim 1, wherein the linear portion of the projectile has a circular cross-section.

17. A toy construction system comprising:

a projectile comprising a linear portion having a first end and a second end, and an engagement portion at the first end;

a base comprising a clamp and a pivot point, the base defining a first opening that receives the second end of the linear portion of the projectile and a second opening that provides access to the second end of the linear portion, and the clamp retaining a portion of the projectile;

a first actuator removably coupled to the pivot point, the first actuator configured to cause release of the projectile from the clamp in a direction parallel to a longitudinal axis of the linear portion when force is applied to the first actuator in a direction that is different from the direction parallel to the longitudinal axis of the linear portion; and a second actuator configured to cause release of the projectile from the clamp when force is applied to the second end of the linear portion of the projectile.

18. The toy construction system of claim 17, wherein the second actuator comprises a building element that pushes the second end of the linear portion.

19. The toy construction system of claim 17, wherein the second end of the linear portion passes through the second opening to an exterior of the base.

20. The toy construction system of claim 17, wherein:

the first actuator comprises a wall portion and a trigger portion, the wall portion being configured to contact the engagement portion of the projectile, and applying force to the first actuator comprises applying force to the trigger portion in a direction that is towards a surface that holds the pivot point to cause the wall portion to move the engagement portion of the projectile in the direction parallel to the longitudinal axis of the linear portion of the projectile.

21. The toy construction system of claim 17, wherein the base comprises a coupling stud and a coupling recess.

22. A device comprising:

a projectile comprising a linear portion that extends along a longitudinal axis, and a flat face and a post that extend radially from the longitudinal axis;

a base comprising a coupling stud, a coupling recess, a pivot point, and a clamp, the base defining an opening in one side that receives the linear portion of the projectile, and the clamp retaining the linear portion of the projectile in the base; and an actuator coupled to the base at the pivot point, the actuator comprising a wall portion and a trigger portion, the wall portion being disposed between the flat face of the projectile and the side of the base that defines the opening, wherein applying force to the trigger portion of the actuator in a first direction causes movement of the flat face of the projectile in a second direction, distinct from the first direction, and releases the projectile from a frictional engagement.

23. A toy construction system comprising:

a plurality of interconnectible building elements; and a toy assembly configured to connect to at least one of the interconnectible building elements, the toy assembly comprising:

a projectile comprising a linear portion and an engagement portion;

a base comprising a pivot point and defining an opening that receives the linear portion of the projectile, the base retaining the projectile in a frictional engagement; and an actuator comprising a trigger portion, the actuator coupled to the base at the pivot point, wherein applying force to the trigger portion of the actuator in a first direction causes movement of the engagement portion of the projectile in a second direction, distinct from the first direction, and releases the projectile from the frictional engagement.

24. A toy assembly comprising:

a projectile comprising:

a linear portion that extends along a longitudinal axis, the linear portion comprising a first end and a second end, and a post that extends radially outward from the longitudinal axis at the first end; and a base defining an opening that receives the linear portion, and the base comprising a clamp extending outward from a surface of the base, the clamp receiving the post that extends radially outward from the longitudinal axis, wherein the projectile is released from the base in response to a force applied directly to the second end of the linear portion.

25. The toy assembly of claim 24, wherein the clamp comprises a c-clip.

26. The toy assembly of claim 25, wherein the base further comprises a post sized to fit into a c-clip of a building element that is separate and distinct from the projectile and the base.

27. The toy assembly of claim 24, wherein when the projectile is released from the base, the post is released from the clamp.

* * * * *